US010918930B2

(12) United States Patent
Hooper et al.

(10) Patent No.: US 10,918,930 B2
(45) Date of Patent: Feb. 16, 2021

(54) GOLF MAT

(71) Applicant: FIBERBUILT MANUFACTURING INC., Calgary (CA)

(72) Inventors: Michael Hooper, Chestermere (CA); Scott Nichol, Calgary (CA); Daniel Fletcher, Calgary (CA)

(73) Assignee: FIBERBUILT MANUFACTURING INC., Calgary (CA)

( * ) Notice: Subject to any disclaimer, the term of this patent is extended or adjusted under 35 U.S.C. 154(b) by 0 days.

(21) Appl. No.: 16/339,247

(22) PCT Filed: Oct. 4, 2017

(86) PCT No.: PCT/CA2017/051187
§ 371 (c)(1),
(2) Date: Apr. 3, 2019

(87) PCT Pub. No.: WO2018/064770
PCT Pub. Date: Apr. 12, 2018

(65) Prior Publication Data

US 2019/0232144 A1 Aug. 1, 2019

Related U.S. Application Data

(60) Provisional application No. 62/404,052, filed on Oct. 4, 2016.

(51) Int. Cl.
*A63B 69/36* (2006.01)
*A63B 71/00* (2006.01)
(Continued)

(52) U.S. Cl.
CPC ..... *A63B 69/3661* (2013.01); *A63B 71/0054* (2013.01); *A63B 2071/0063* (2013.01);
(Continued)

(58) Field of Classification Search
CPC ..... A63B 69/3661; A63B 71/0054; A63B 2210/50; A63B 2071/0694;
(Continued)

(56) References Cited

U.S. PATENT DOCUMENTS 3,599,982 A 8/1971 Elesh
4,844,470 A * 7/1989 Hammon ..... A63B 69/3661 473/278
(Continued)

FOREIGN PATENT DOCUMENTS

CA 2517344 A1 9/2004
DE 19531325 A1 2/1997
(Continued)

*Primary Examiner* — Nini F Legesse
(74) *Attorney, Agent, or Firm* — Bennett Jones LLP

(57) ABSTRACT

A golf mat that has a natural feel and mitigates injury during mat striking includes: a base, the base including a main structure with an upper surface and an open topped cavity in the upper surface; and an insert sized to be accommodated in the cavity, the insert including a layer of solid polymeric material selected to have shock absorption properties greater than the main structure; and artificial turf installed on the base and overlying at least a portion of the main structure and the insert.

18 Claims, 16 Drawing Sheets

(51) Int. Cl.
*A63B 71/06* (2006.01)
*A63B 102/32* (2015.01)

(52) U.S. Cl.
CPC ... *A63B 2071/0694* (2013.01); *A63B 2102/32* (2015.10); *A63B 2209/08* (2013.01); *A63B 2209/10* (2013.01); *A63B 2209/14* (2013.01); *A63B 2210/50* (2013.01)

(58) Field of Classification Search
CPC ..... A63B 2102/32; A63B 2071/0063; A63B 2209/08; A63B 2209/10; A63B 2209/14
See application file for complete search history.

(56) References Cited

U.S. PATENT DOCUMENTS 5,004,243 A 4/1991 Dlouhy
5,110,133 A * 5/1992 Durso ..... A63B 69/3667 273/DIG. 30
5,156,398 A * 10/1992 Kibamoto ..... A63B 69/3661 473/278
6,106,409 A * 8/2000 Jackson, Jr. ..... A63B 69/3661 473/278
6,705,953 B2 * 3/2004 Haskins ..... A63B 69/3661 473/150
6,746,340 B1 6/2004 Dover
6,851,141 B2 * 2/2005 McMahan ..... A47G 27/0231 428/102
7,070,511 B2 7/2006 Gustine
8,303,430 B2 * 11/2012 Li ..... A63B 69/3661 473/278
8,307,482 B2 * 11/2012 Gladney ..... A47C 27/148 5/727
8,668,977 B2 * 3/2014 Callsen ..... A47C 27/146 428/172
9,254,431 B1 2/2016 Sites
2003/0135930 A1 * 7/2003 Varese ..... A47C 27/148 5/727
2004/0162155 A1 * 8/2004 Sear ..... A63B 69/3661 473/278
2008/0032811 A1 * 2/2008 Bearden ..... A63B 69/3661 473/278
2008/0034614 A1 * 2/2008 Fox ..... A43B 17/026 36/43
2008/0070713 A1 * 3/2008 Scarbrow ..... A63B 69/3661 473/278
2009/0004409 A1 * 1/2009 McCoy ..... A01K 1/0353 428/17
2012/0233784 A1 * 9/2012 Wood ..... A47C 27/085 5/727
2013/0011621 A1 * 1/2013 Russell ..... C08G 18/6662 428/159
2016/0037949 A1 * 2/2016 Dawson ..... E04F 15/186 428/95

FOREIGN PATENT DOCUMENTS

GB 2315024 A 1/1998
JP 08164232 6/1996
KR 2008-0037774 5/2008
KR 100942630 B1 2/2010
KR 20150062029 6/2015
KR 20160139584 12/2016
WO WO2005/11822 2/2005

* cited by examiner

10

GOLF MAT

BACKGROUND

During a golf swing, the golf club is supposed to bottom out after the club hits the ball. In some types of swings, the club is intended to impact the ground after the ball. Sometimes, the club bottoms out, for example hits the ground, before the ball is impacted. While hitting the ground before hitting the ball is not a good swing characteristic, it is a common amateur problem.

Either way, when using a golf mat, the unforgiving mat surface does not respond well to the bottoming out of the club. The bottoming out often does not have a natural feel and sometimes can cause injury.

SUMMARY OF INVENTION

A golf mat has been invented that has realistic club impact feel and mitigates injury when ball striking.

In accordance with a broad aspect of the invention, there is provided a golf mat comprising: a base, the base including a main structure and an insert in the main structure, the insert configured to have shock absorption properties; and a top layer of sheet material installed on the base and overlying at least a portion of the main structure and the insert.

In accordance with another broad aspect, there is provided golf mat comprising: a base, the base including a main structure with an upper surface and an open topped cavity in the upper surface; and an insert sized to be accommodated in the cavity, the insert including a layer of solid polymeric material selected to have shock absorption properties greater than the main structure; and artificial turf installed on the base and overlying at least a portion of the main structure and the insert.

It is to be understood that other aspects of the present invention will become readily apparent to those skilled in the art from the following detailed description, wherein various embodiments of the invention are shown and described by way of illustration. As will be realized, the invention is capable for other and different embodiments and its several details are capable of modification in various other respects, all without departing from the claim scope of the present invention. Accordingly the drawings and detailed description are to be regarded as illustrative in nature and not as restrictive.

BRIEF DESCRIPTION OF THE DRAWINGS

Referring to the drawings, several aspects of the present invention are illustrated by way of example, and not by way of limitation, in detail in the figures, wherein.

DESCRIPTION OF VARIOUS EMBODIMENTS

Figure 1:
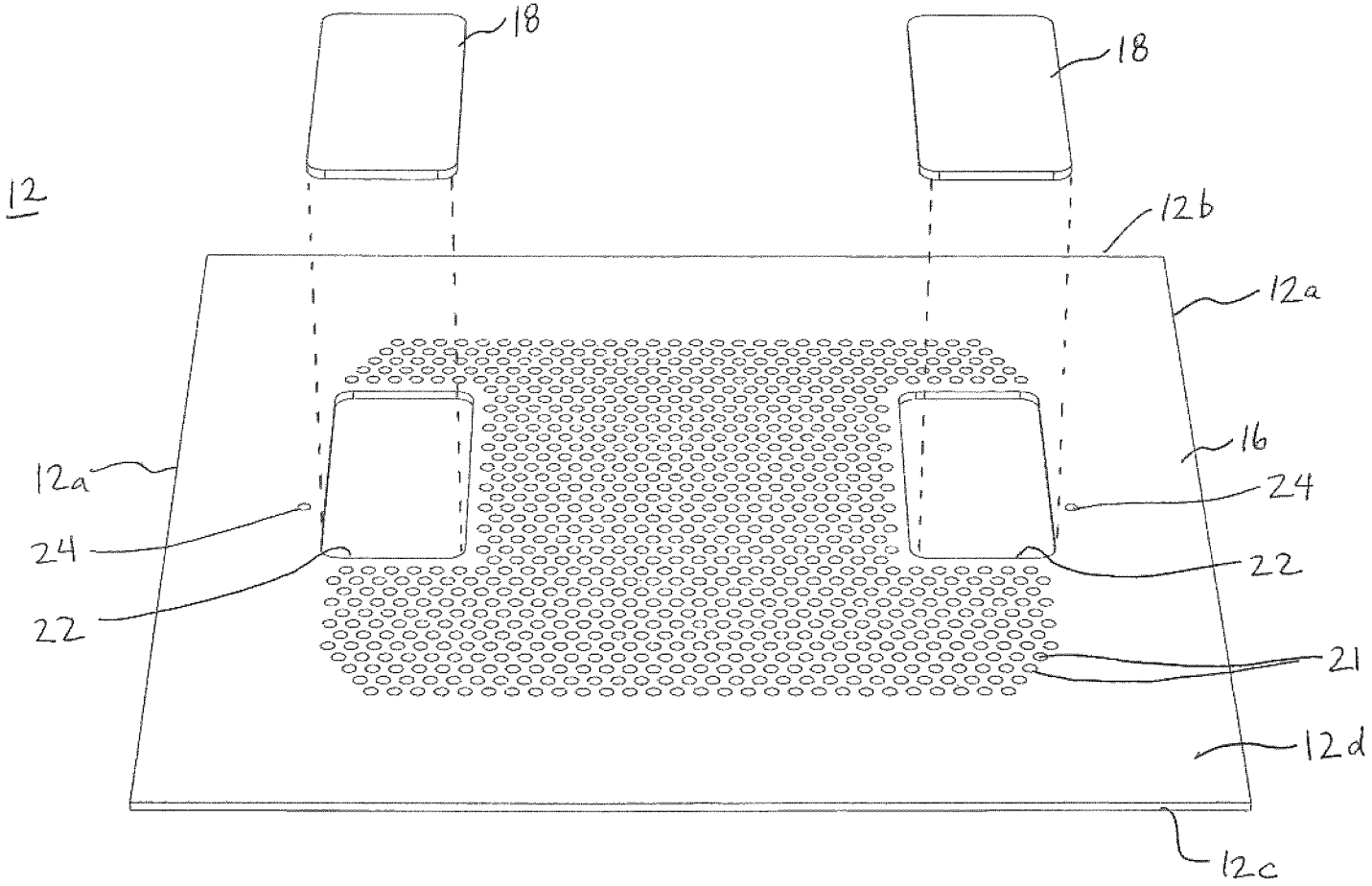
FIG. 1 is an exploded, top perspective view of a golf mat base including a main structure and shock absorbing inserts aligned for installation.

The description that follows, and the embodiments described therein, is provided by way of illustration of an example, or examples, of particular embodiments of the principles of various aspects of the present invention. These examples are provided for the purposes of explanation, and not of limitation, of those principles and of the invention in its various aspects. In the description, similar parts are marked throughout the specification and the drawings with the same respective reference numerals. The drawings are not necessarily to scale and in some instances proportions may have been exaggerated in order more clearly to depict certain features.

Golf mat embodiments are shown in FIGS. 3, 6, 7 and 10. While there are some differences between these mats, identical reference numbers are used for similar parts.

A golf mat 10, such as one shown in FIG. 3, 6, 7 or 10, includes a base 12 and a top layer of sheet material 14.

Golf mat base 12 includes a main structure 16 and an insert 18 in the main structure. While the main structure is constructed for durability, the insert is constructed for shock absorption.

Figure 2:
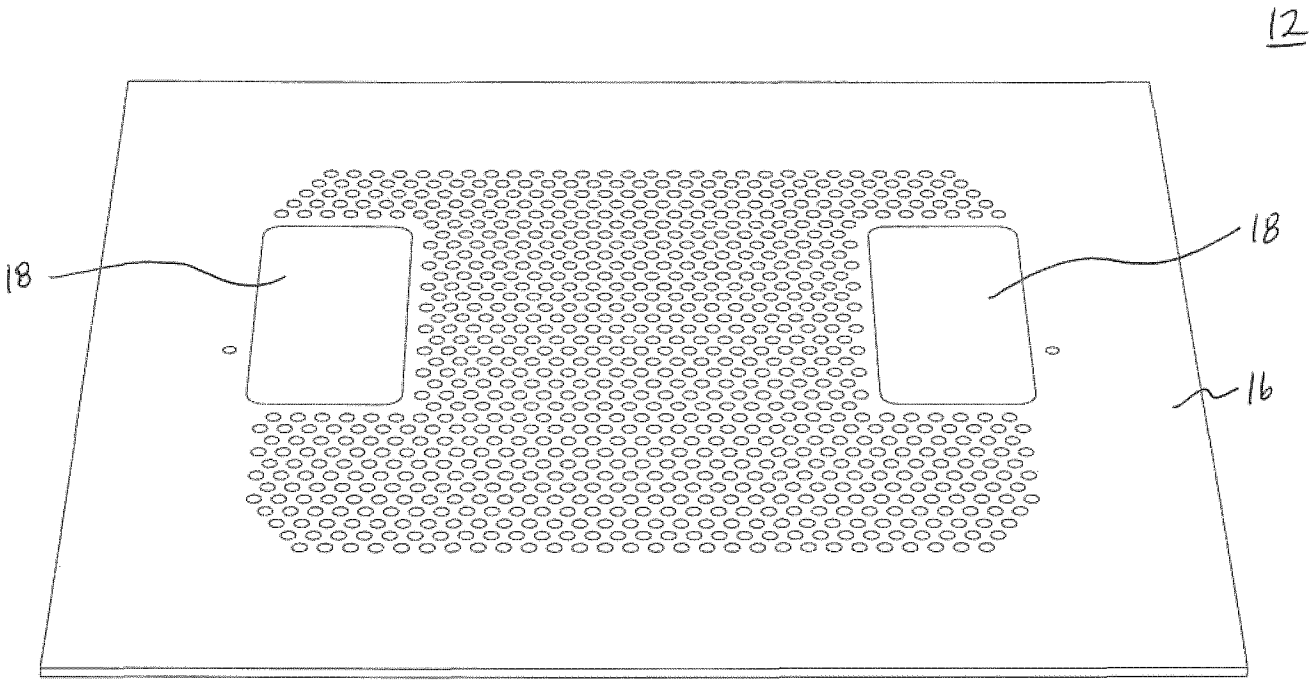
FIG. 2 is a top perspective view of an assembled base including the main structure of FIG. 1 and inserts installed in the main structure.
Figure 3:
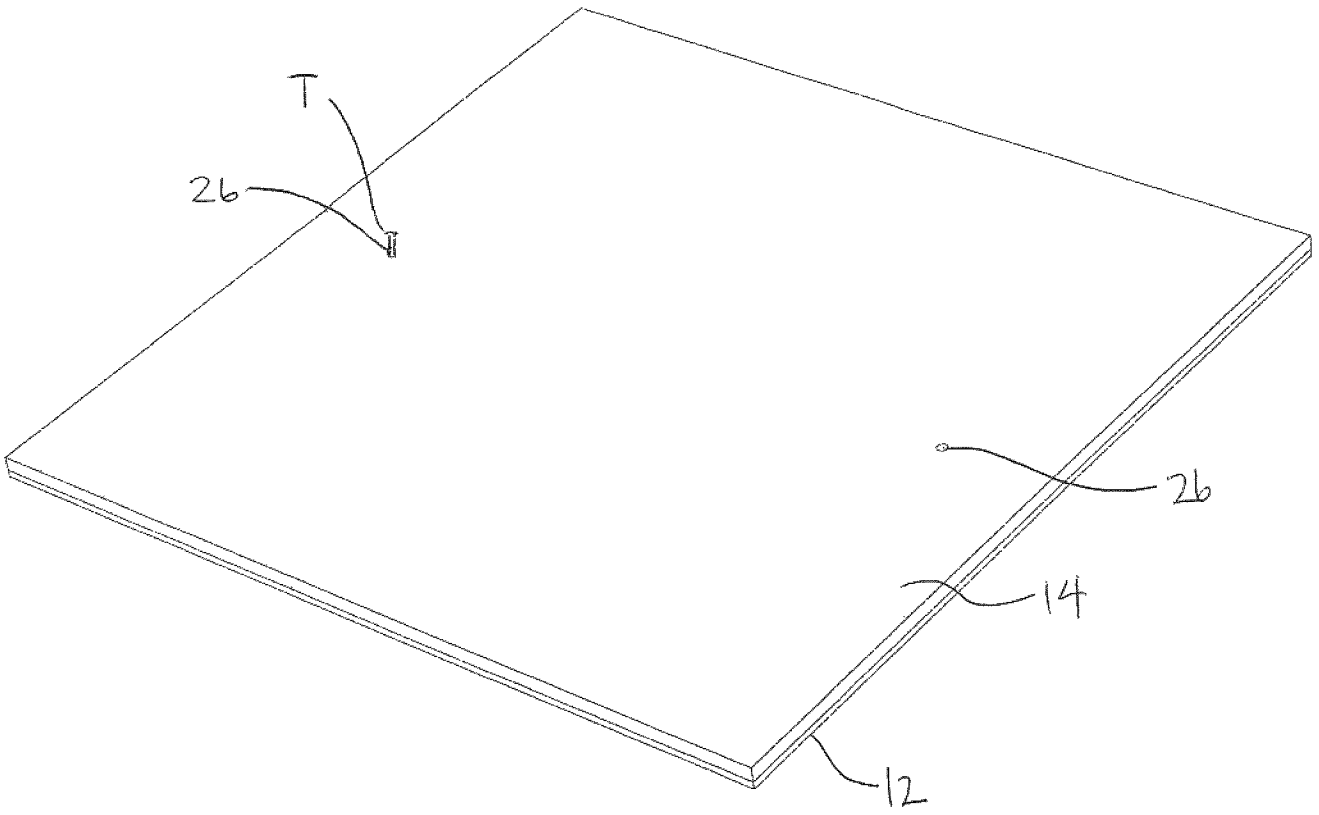
FIG. 3 is a top perspective view of a fully assembled golf mat including the base of FIG. 2.
Figure 3A:
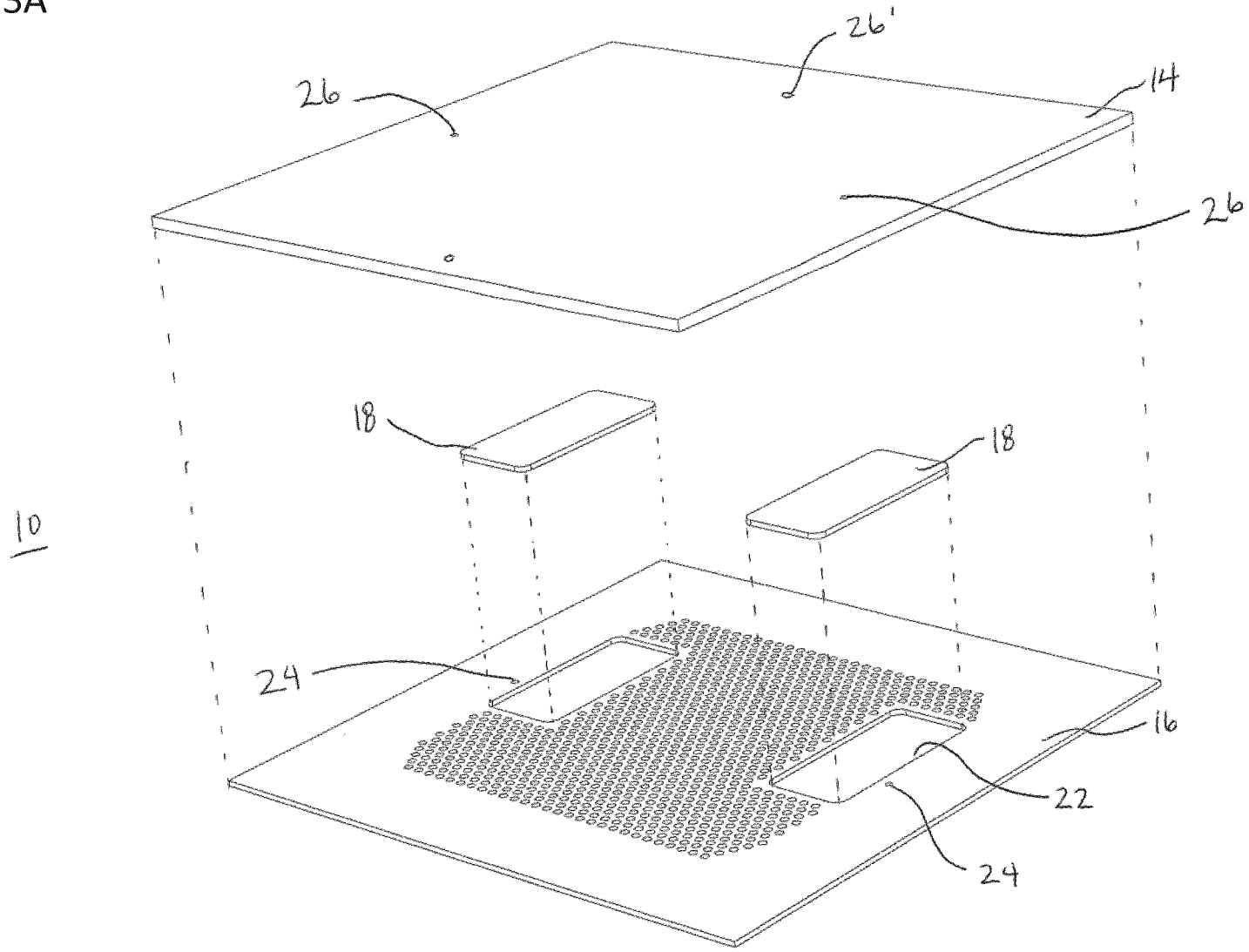
FIG. 3A is an exploded view of the golf mat of FIG. 3.

FIG. 1 shows a base main structure 16 with two inserts 18 aligned above. FIG. 2 shows the main structure of FIG. 1 with inserts 18 installed in it. FIG. 3 is the assembled golf mat 10 including the base of FIG. 1. This mat includes two inserts and is useful by both left hand and right hand golfers. There is space for the golfer to stand on the mat, on the turf sheet material layer 14 in the area between the inserts, while hitting a ball from the mat.

Figure 4:
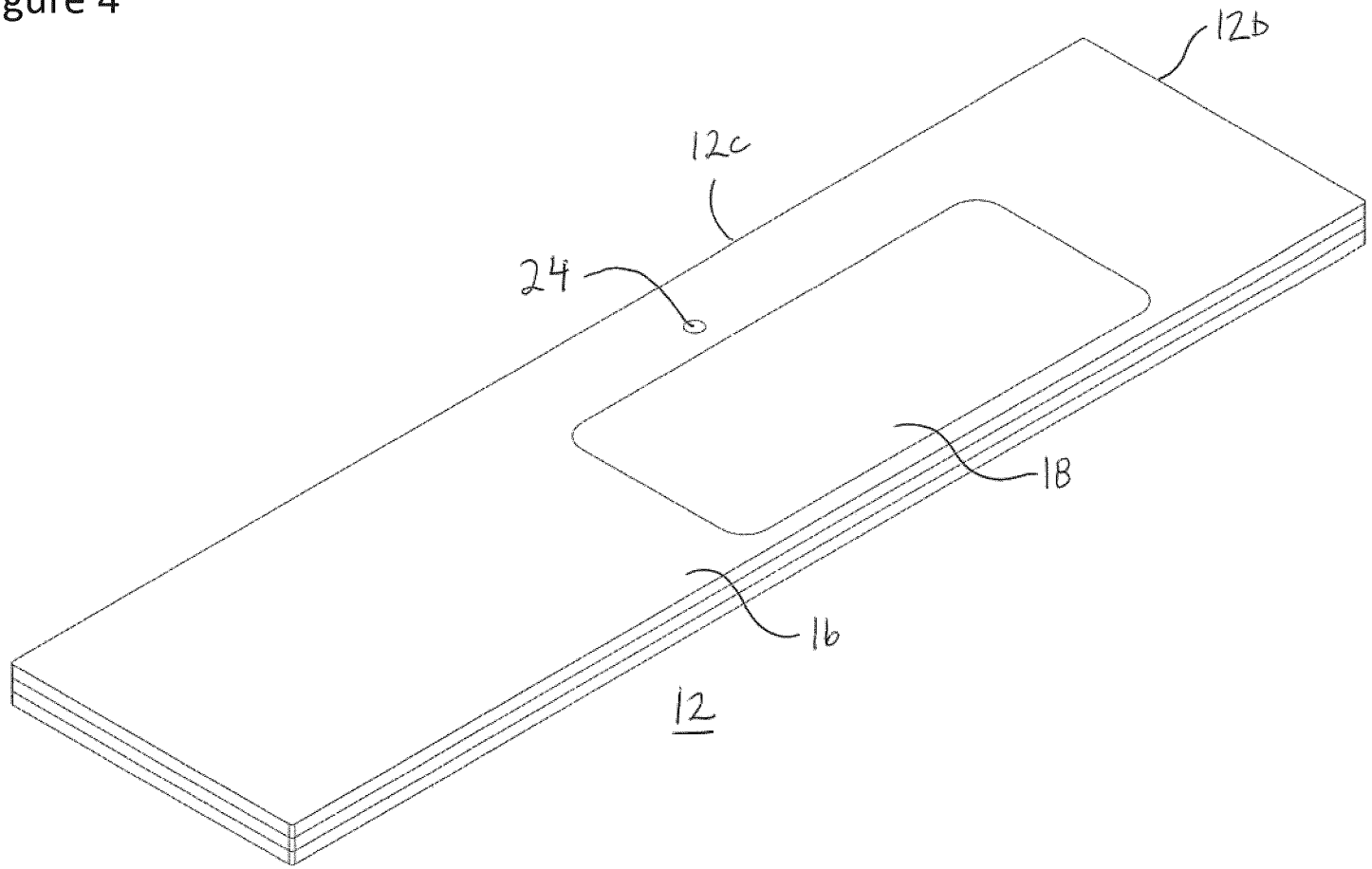
FIG. 4 is a top perspective view of another golf mat base with an insert installed in the main structure.
Figure 4A:
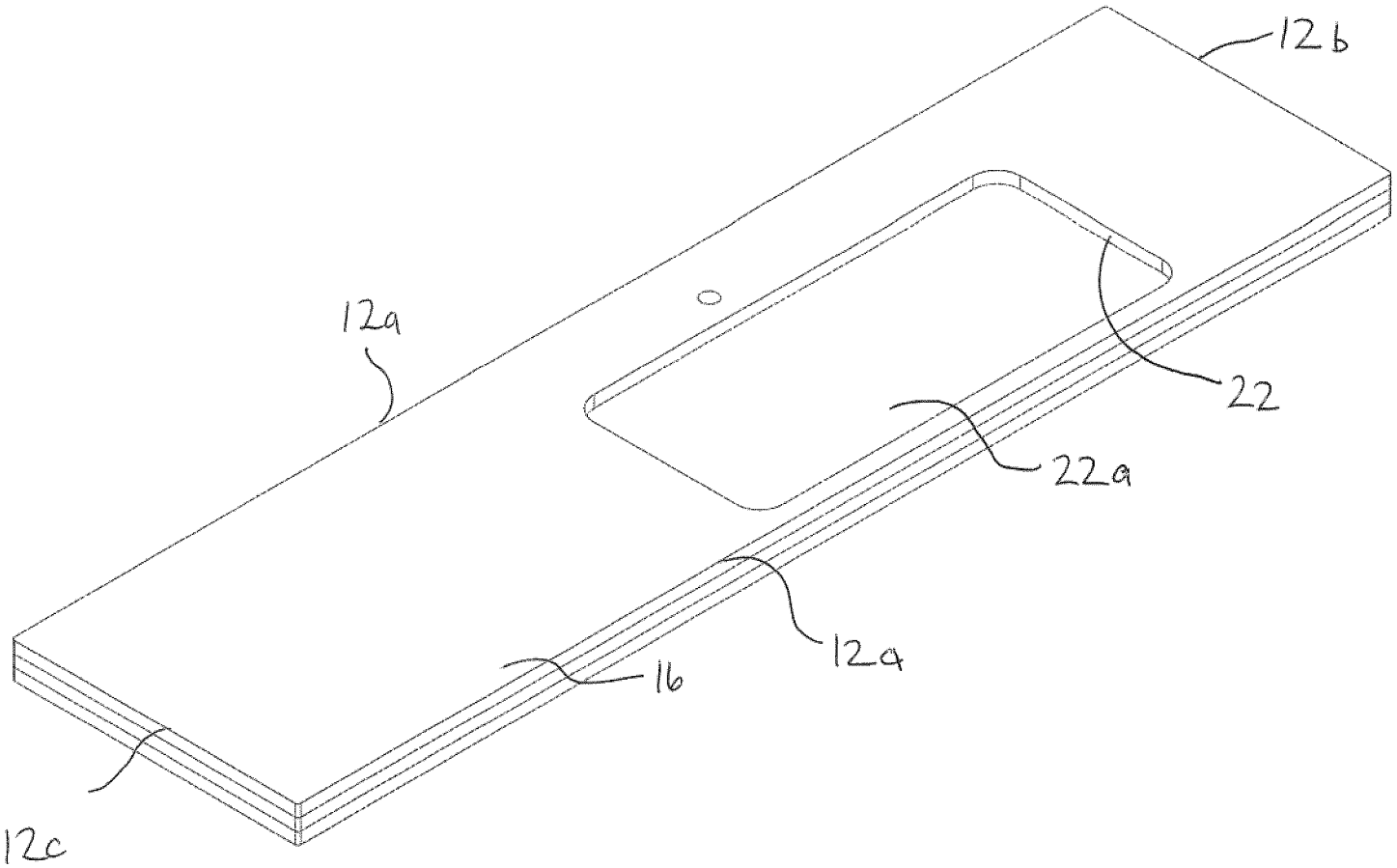
FIG. 4A is a top perspective view of the main structure of FIG. 4 with the insert removed.
Figure 5:
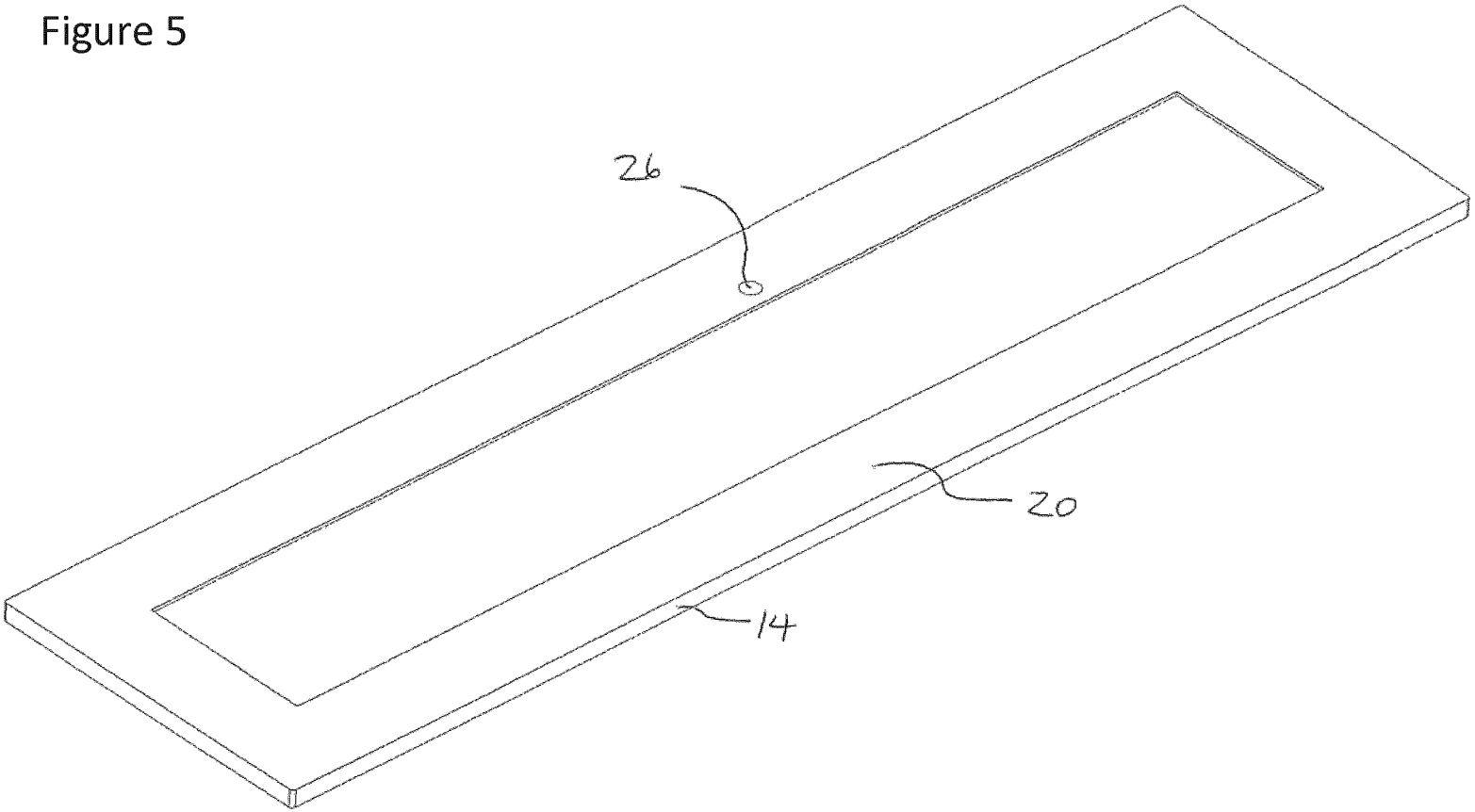
FIG. 5 is a perspective view of the underside of a top layer of sheet material for the golf mat base of FIG. 4.
Figure 6:
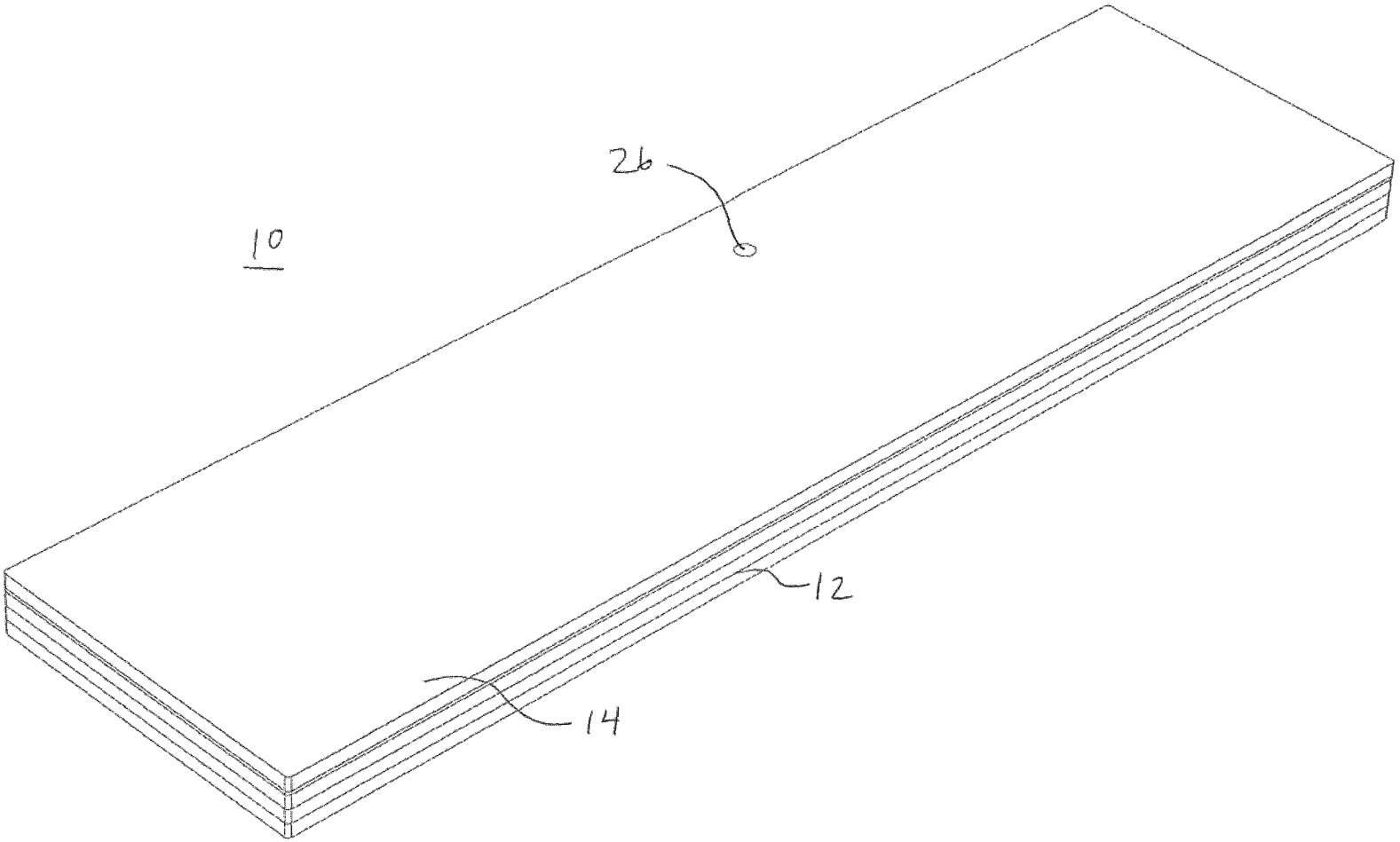
FIG. 6 is a top perspective view of a fully assembled golf mat including the base of FIG. 4 and the top layer of FIG. 5.
Figure 6A:
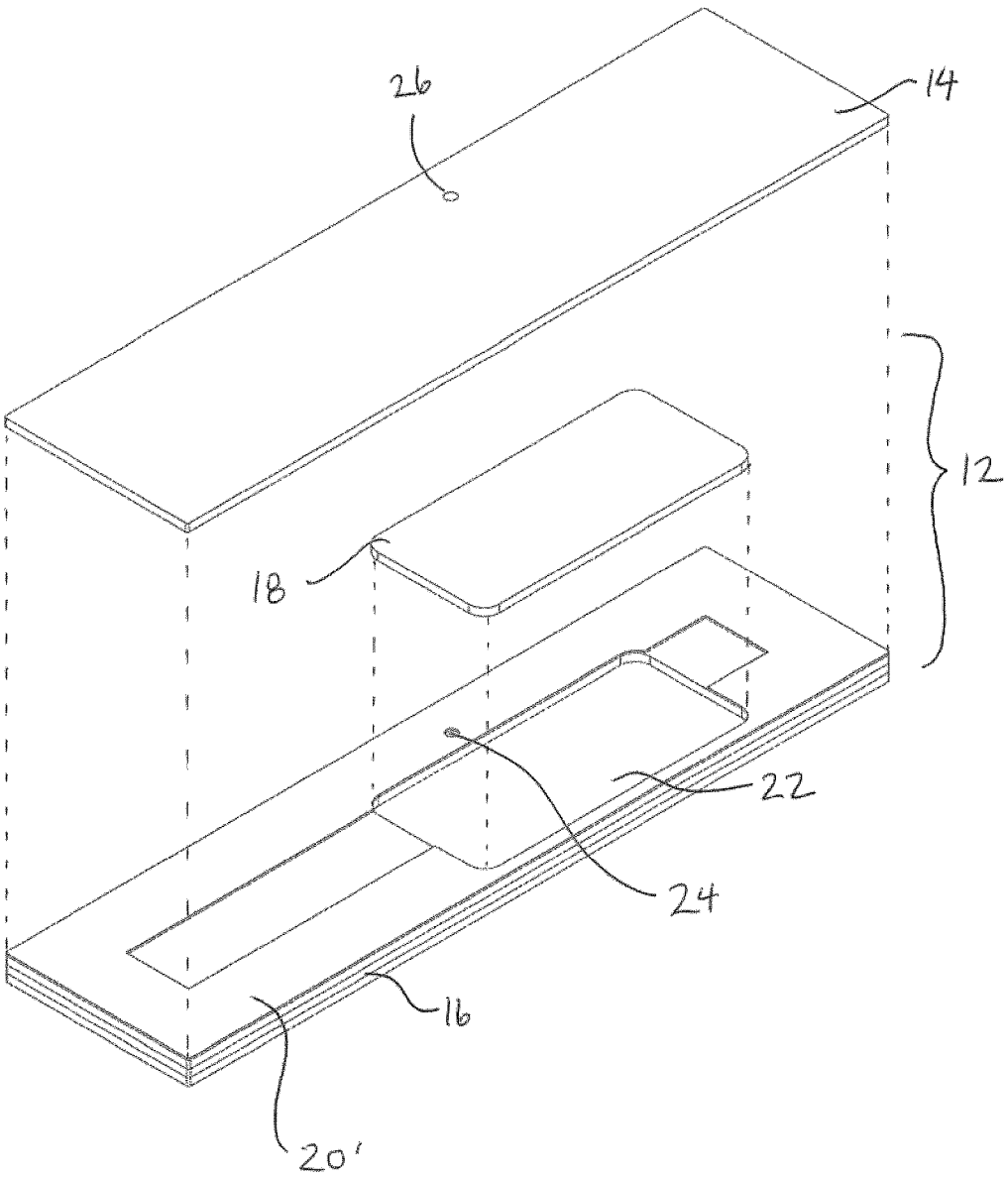
FIG. 6A is an exploded view of the golf mat of FIG. 6.

The assembled mat of FIG. 6 a rectangular-shaped golf mat intended for use by a golfer that stands alongside the mat while a ball is hit from the mat. The mat of FIG. 6 includes the base of FIG. 4 and the top layer of FIG. 5. FIG. 4 shows an assembled base 12 including main structure 16 and insert 18 installed therein, while FIG. 4A shows the main structure of the base without an insert. FIG. 5 shows an underside 14*a* of a top layer that fits that base. Top layer includes connectors 20, such as for example hook and loop fastener connector strips (i.e. Velcro™)

Figure 7:
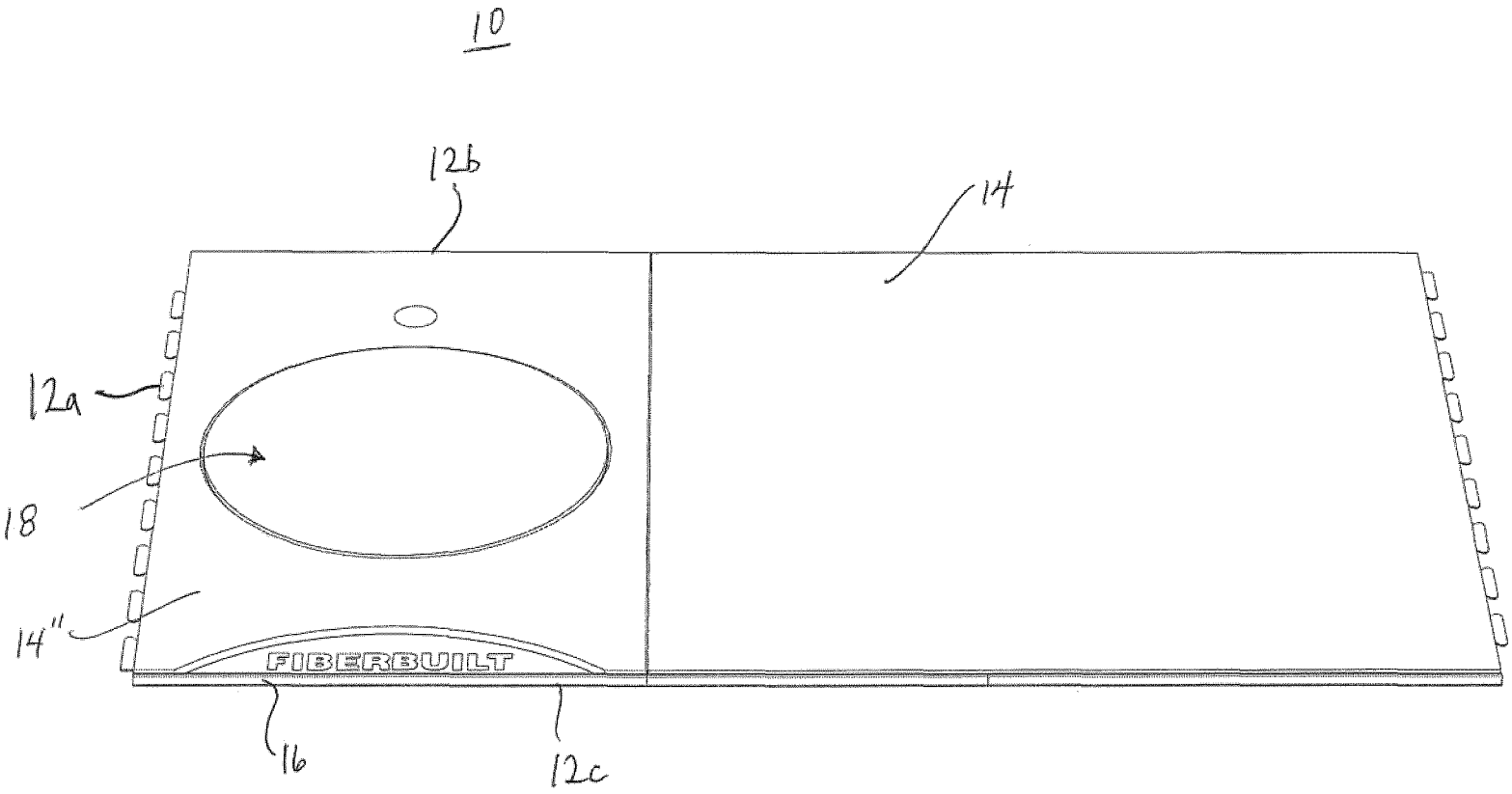
FIG. 7 is a top perspective view of another assembled golf mat.
Figure 7A:
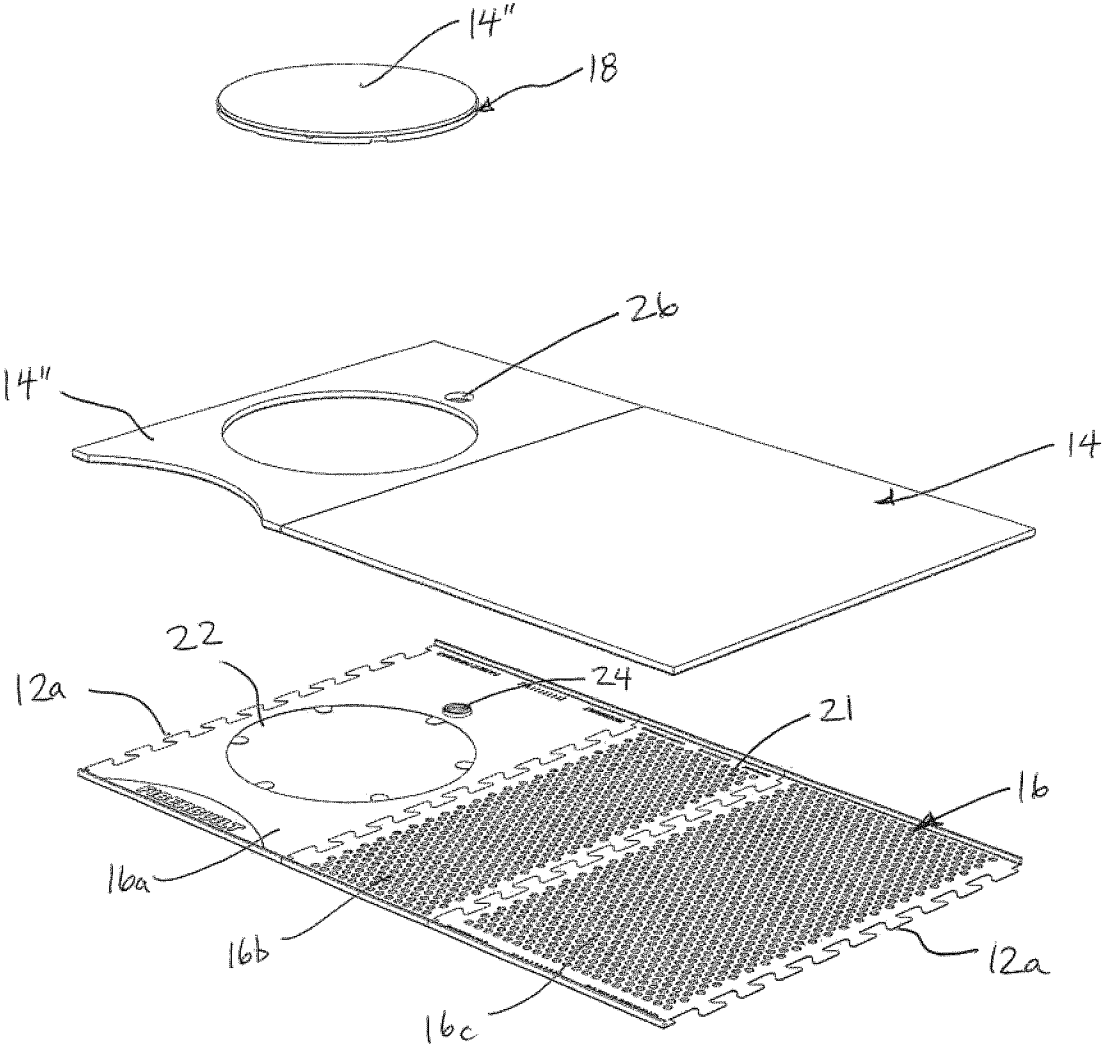
FIG. 7A is an exploded view of the golf mat of FIG. 7.
Figure 9:
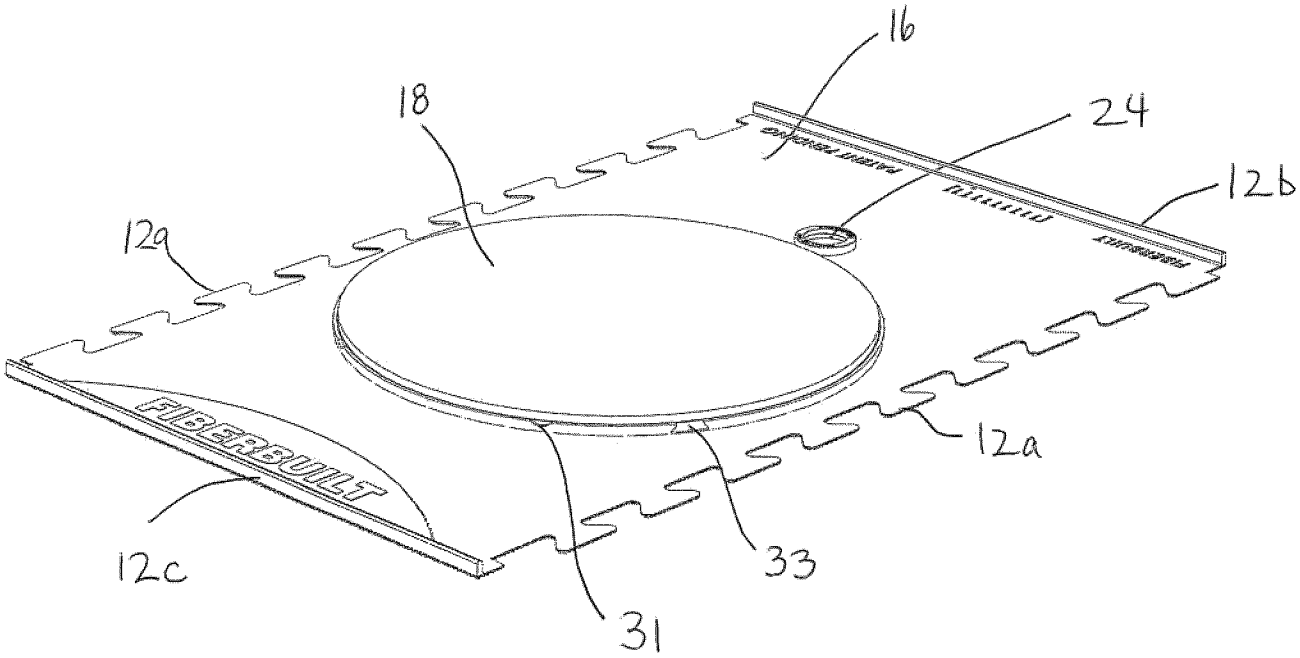
FIG. 9 is a top perspective view of a golf mat base.
Figure 9A:
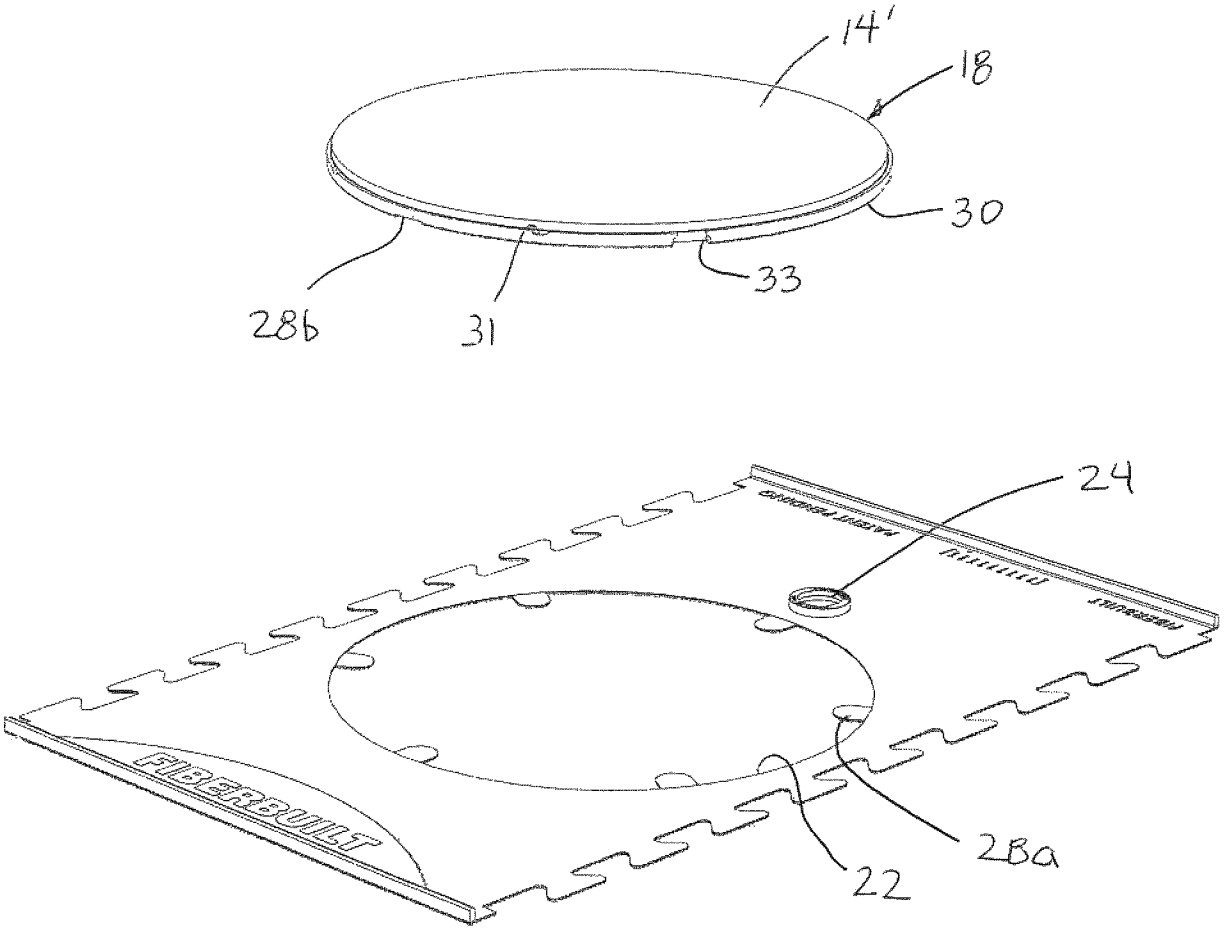
FIG. 9A is an exploded top perspective view of the golf mat base of FIG. 9 with the insert aligned for installation.

FIG. 7 shows an assembled mat, which is shown exploded in FIG. 7A. Mat 10 has a base with main structure 16 accepts a shock absorbing insert 18. A ball hitting section of the mat of FIG. 7 is shown in FIGS. 9 and 9A. While the mat of FIG. 7 has a standing area, where a golfer can stand while using the hitting area, the mat can be used with the ball hitting section alone or in other configurations with adjacent mats.

In these golf mats, main structure 16 is formed of a durable, hard material and each insert 18 includes or is formed entirely of a material that has greater shock absorption than the material of the main structure. The main structure may, for example, be formed of a rubber such as a natural rubber or synthetic rubber such as of styrene-butadiene rubber, butyl rubber or poly butadiene rubber, all of which may be new or recycled. The insert may for example include a resilient material configured to provide shock absorption, good memory, vibration isolation and vibration damping characteristics. The insert may for example be formed of a material with an elastomeric, such as a viscoelastomeric, characteristic greater than the material used for construction of the main structure, which generally includes the rubbers noted above. That is, the shock absorbing material of the insert may be selected to have a higher shock damping coefficient than the material used to construct the main structure. In one embodiment, the insert may include a shock absorbing material formed of a viscoelastic material. In one embodiment, the shock absorbing material of the insert may be a substantially solid structure such as a solid block, pad or layer, without springs, hollowed out chambers, foam or fluid fill. A solid viscoelastomeric structure may have many advantages over the use of springs, foam or fluid (i.e. liquid, gel or gas) filled chambers in respect of durability, reliability and speed of recovery and an impact sound and feel that more closely resembles real turf. The solid shock absorbing material structure may extend out to the edges of the area where shock absorption is to be provided on the mat, which is generally to the edges of the insert.

The main structure may include recesses, apertures 21, etc., according to techniques that are used to reduce weight and material volume. As will become apparent herein below, the main structure can be varied in shape and construction. However, main structure 16 retains the insert and provides a support on which sheet material 14 is secured.

The insert is positioned in the area of the mat where the mat is contacted by the club head when a ball is hit from the mat. The insert is positioned along, close to a side edge 10*a* and generally centrally between the front edge 10*b* and the rear edge 10*c*. In one embodiment, the insert is positioned close to a side edge and generally central but closer to the front than the rear. This position with the insert closer to the front edge provides shock absorption for a proper swing where the golf club hits the ground after striking the ball.

While the insert may extend out to form an edge of the mat, generally the main structure forms a frame about an opening that defines a cavity 22 into which the insert 18 fits. Stated another way, the main structure creates all the side edges 12*a*, front edge 12*b* and rear edge 12*c* of the golf mat base and the insert fits into cavity 22 indented into the upper surface 12*d* and spaced from the edges of the mat base. The insert can have a perimeter shape that follows the perimeter shape of the opening of the cavity. Cavity 22 in the main structure in which the insert 18 is installed is only slightly larger than the insert. This ensures that insert fits snugly in the cavity and does not tend to move from side to side within the cavity.

Figure 8:
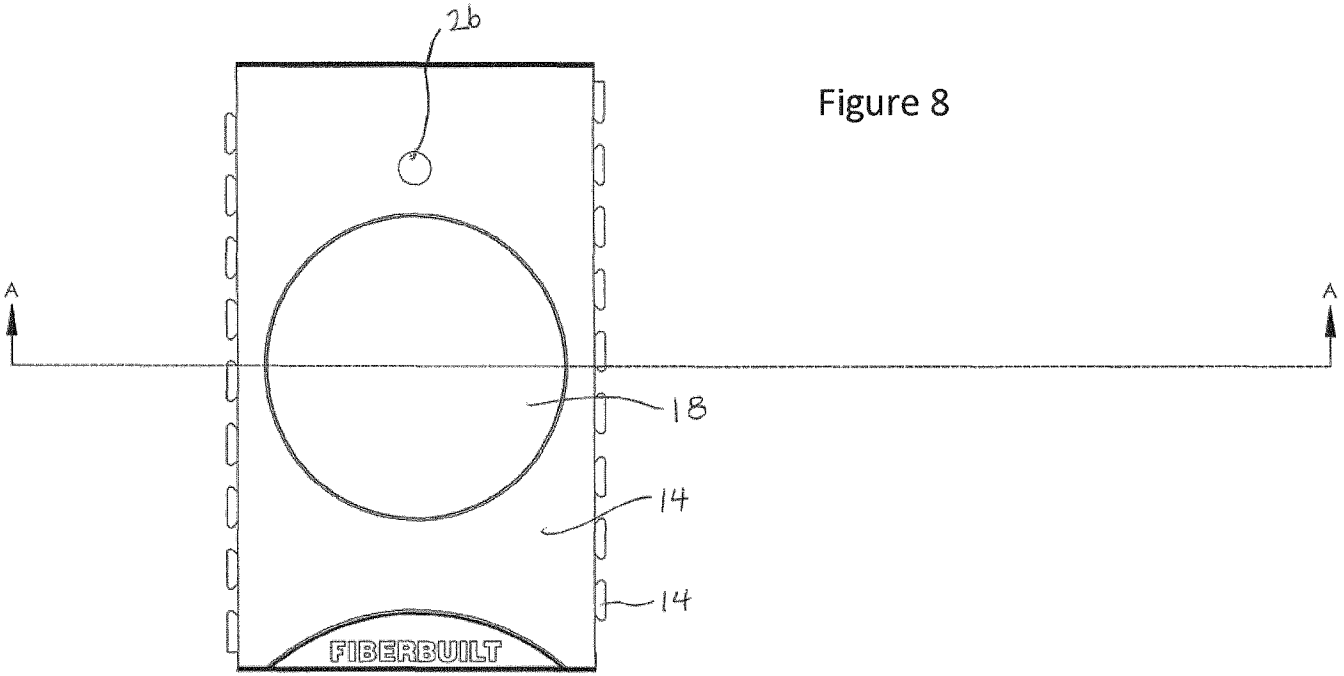
FIG. 8 is a top plan view of a ball hitting section of the golf mat of FIG. 7.
Figure 8A:
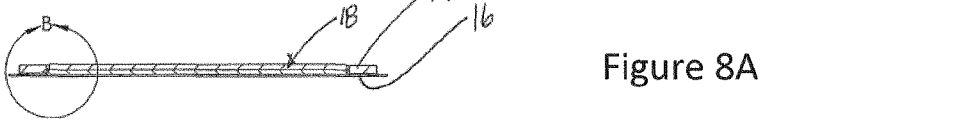
FIG. 8A is a section along line A-A of FIG. 8.
Figure 8B:
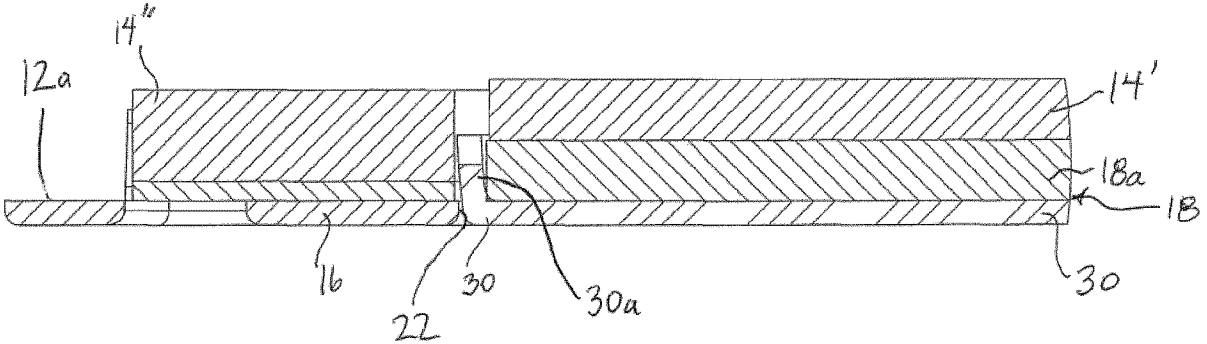
FIG. 8B is an enlargement of the portion B of FIG. 8A.

Cavity 22 can be a hole that passes fully through the mat (as shown in FIGS. 1 and 8B) or cavity 22 can be a recess on the upper surface of the main structure, but has a return or is fully closed at its bottom end 22*a* (as shown in FIG. 4A).

The insert can have substantially vertical side walls. Alternately, the insert can be wider across its upper surface that its bottom surface (i.e. generally wedge shaped) or may include an outwardly extending flange on its upper end to overly the edges of the cavity, to prevent the insert from falling down through the opening. This may be particularly useful in an embodiment where there is no bottom 22*a*, as the wedge-shaping or flanges on the insert may prevent the insert from becoming dislodged or falling out of position when moving the mat.

The insert may be tacked by glue into the main structure or held by releasable fasteners, such as Velcro or magnets. However in many embodiments, the insert is readily releasable, such as by lifting, from the cavity. For example, the insert may be held in place simply by its fit within cavity 22.

Golfers may wish to practice with a ball supported either on a tee or on the mat. A golf mat therefore generally includes an artificial tee or a tee holder T. The base may include a tee placement hole 24. The upper layer of sheet material may also have a tee hole 26 that is alignable over the tee placement hole 24. An artificial tee or a tee holder T is inserted into the tee placement hole and extends up through hole 26 in top layer 14 to be held in place on the mat.

The tee may be positioned along an edge such as a side edge 12*a* or a front edge 12*b*, rather than being in the middle of the mat. In one embodiment, the holes 24, 26 are positioned close along a side edge, as shown in FIGS. 3 and 6. In such an embodiment, the tee is positioned generally centrally between the front edge 12*b* and the rear edge 12*c*.

There are many tee holder designs, so the holes 24, 26 may vary in shape, size and position. A tee placement hole 24 may, for example, pass fully through the base. The tee placement hole may have a very small diameter (about ⅛ to ¼ inch) to accept a regular tee or a hole of ¼ to ¾ inch to accept a rubber tee. To accept a rubber tee, the underside of the base may include a recess around the tee placement hole. In the mat of FIG. 7, for example, the upper layer has tee hole 26 configured to support a wide diameter tee holder. Also, the hole 26 in FIG. 7 is positioned closer to a front edge 12*b* than a side edge and generally centrally between the side edges 12*a*.

The insert may be positioned on the base about or adjacent to the tee holes 24, 26. In one embodiment, the tee holes are positioned adjacent to but not within the insert since a club head does not often strike the mat when using the tee. In one embodiment, the insert is positioned adjacent an edge of the mat and the tee holes are positioned in between the insert and that edge of the mat base. For example, in FIGS. 4-6A, the side edge 12*a* defines a line between the front and the rear of the mat and insert 18 and cavity 22 are positioned along, but spaced from that side edge 12*a* and the tee placement hole 24 is positioned between the insert and the side edge. A line orthogonal to the side edge that passes through the tee placement hole 24, which is a hole in the main structure, also would extend into the insert.

Another configuration is shown in FIGS. 7 and 9, wherein the tee hole 26 is positioned between the insert and the front edge 12*b*. Again, however, a line orthogonal to front edge 12*b* and passing through hole 26 would also pass into insert 18 and cavity 22.

As noted above, the mat may be one intended to accept the golfer and the ball (FIGS. 3 and 7) or the mat may be one intended only to support the ball (FIGS. 6 and 9) while the golfer stands alongside but not on the mat. The mat base that is sized only to support the ball, may have a smaller side to side dimension for example only about 8 to 18 inches from side edge to side edge. However, the mat base that is intended to accept both the golfer and the ball may be larger for example having a side edge to side edge dimension of about 3 to 6 feet and have more uniform front to back and side to side dimensions than the mat that is intended to only support the ball. In particular, the mat may be formed as a large square, circle or oval with similar front to back and side to side dimensions. The mat intended to support a golfer, such as that of FIGS. 1 to 3A, can have an insert and possibly a tee placement hole on each side edge, such that the mat can be used for both left-handed or right-handed golfers.

The top layer of sheet material 14 overlies the main structure and the insert(s). The top layer is generally a material such as artificial turf for example green colored material sometimes with upstanding loops or bristles resembling grass. The top layer may be thin or more substantive with foam or reinforcement backing. There may be one unitary piece of sheet material (FIG. 6) that covers all of the main structure and inserts. Alternately, sheet material may be segmented (FIGS. 7 and 9) and applied to individual portions of the base. In such an embodiment, for example, there may be a portion of sheet material 14' coupled to the insert that is separate from a portion 14" of sheet material coupled to the main structure 16.

Figure 8C:
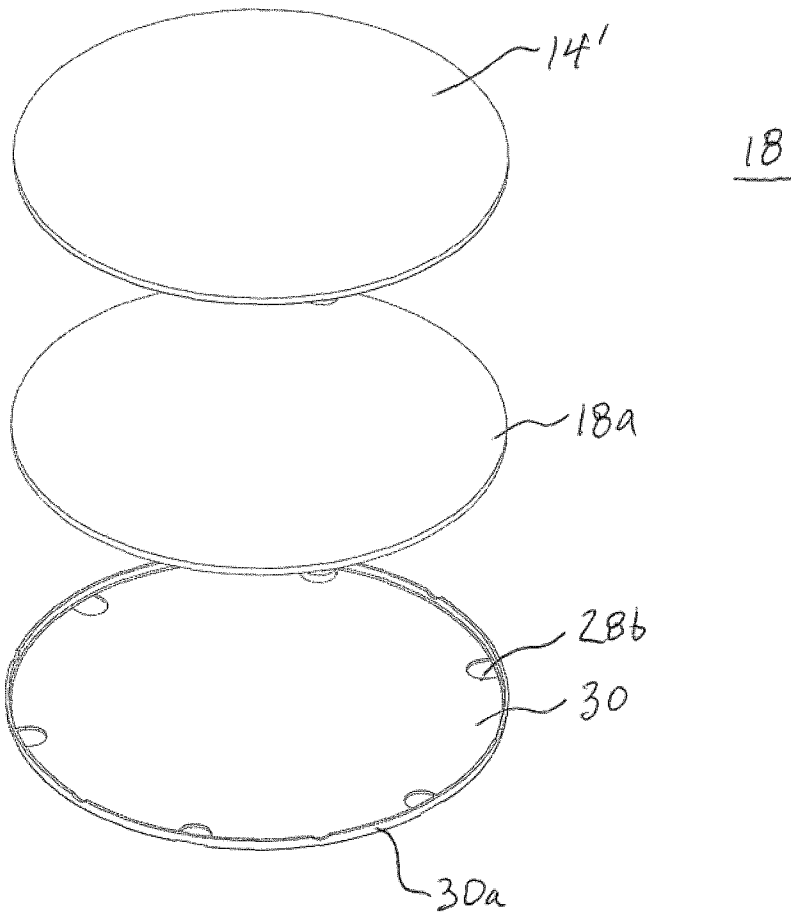
FIG. 8C is an exploded perspective view of an insert useful for the mat of FIG. 8.

The top layer may be secured on the base in various ways. In one embodiment, the top layer is removable from the base, for exampling including a releasable connector 20 that cooperates with another connector on the base. Alternately, the top layer 14' may be permanently installed to some or all of the base (FIG. 8C). In the embodiment of FIG. 7, a portion of the top layer 14' is permanently coupled to the part on which it is installed, in that case insert 18, and another portion 14" is removable from the part on which it is installed, in that case main structure 16.

The top layer can be configured for re-orientation on the base to extend the life of the top layer. If one side of the top layer becomes worn, for example, near the right side or left side edge, near the tee, the top layer may be pulled off the base, rotated a quarter or half turn and replaced onto the base. The top layer may have one or more tee placement holes 26' (FIG. 3B) that are additional to those actually needed in operation, such as one tee placement hole on each edge, so that they are available if the top layer is rotated to address wear.

While the mats of FIGS. 3, 6 and 7 are similar in many ways, as noted above, they do have some optional features and variations with respect the construction of the main structure, insert and upper layer of sheet material.

For example, in FIGS. 3 and 6, insert 18 is substantially rectangular pad of shock absorbing material. While the insert may have a thin coating, it is for the most part formed entirely of a solid shock absorbing material such as of viscoelastic material. Cavity 22 is formed and positioned on the base such that insert 18 is oriented with the long side aligned between the front edge and the rear edge. This orientation follows the usual impact zone of a club head against the mat. The opening in which the insert is installed may also be rectangular to accept the insert in the correct orientation.

Also with respect to the mats of FIGS. 3 and 6, in those embodiments, top layer 14 is a single sheet that lays over the base. The depth of the cavity (i.e. the height of the cavity walls from bottom 22*a* to the upper surface of main structure around the cavity) is approximately the same as the thickness of the insert such that when the insert is installed in the cavity, the top surface of the insert lies substantially in plane with the upper surface of the main structure. Thus, the overall upper surface of the base is substantially flat. Thus, when top layer 14 is laid over, it assumes a smooth configuration and, in fact, it is not apparent that the insert is present beneath the top layer.

In the embodiment of FIG. 6, the entire top layer 14 is releasable connected to the base. For example, top layer is installed by connectors 20 in the form of a hook and loop fastener such as Velcro™. The connectors 20 may be installed on the underside of the top layer and cooperating connectors 20' may be installed on the top surface of the base. In one embodiment, the hook and loop fastener is applied along all the edges of both the base and the top layer. The cooperating hook and loop fasteners may be applied on substantially the entire contacting surfaces between the top layer and the base except the area at the insert.

The mats of FIGS. 7 to 9B have various features of interest. For example, in this embodiment, base 12 is formed to fit together with adjacent mats such that while side edges 12*a* of the other mats were straight, edges 12*a* of the mat of FIGS. 7 and 9B have jig-saw type cuts to releasable lock together with other similar mat side edges.

Also, as shown in FIG. 7A, the main structure 16 of the base may be formed in interlockable segments such that the dimensions of the mat can be selected. For example, the main structure for hitting area 16*a* can be releasable connected to a main structure for a stance area of narrow sizing 16*b* or wider sizing 16*c* or even another hitting area.

Also, in the embodiment of FIGS. 7 to 9B, insert 18 is circular in shape. As noted above, over time, the hitting surface tends to wear due to repeated club contacts. Being circular, as insert wears during use, it can be rotated (i.e. in plane rotation about the center point of the circle) within its cavity 22, which is also circular. To prevent the insert from freely rotating within the cavity, there may be a releasable interlock between them. In one embodiment, for example, the cavity may have tabs 28*a* that fit into notches 28*b* on insert 18. Tabs 28*a* may extend radially inwardly from the side walls of the cavity. Notches 28*b* may be shaped, spaced and sized to fit and engage over the tabs. In one embodiment, tabs 28*a* are evenly spaced such that the insert can readily be fit and engaged thereover in a large number of rotational orientations of the insert relative to the cavity.

Also, FIGS. 8A-8C show that in addition to the shock absorbing material 18*a*, insert 18 also includes a backing plate 30 and a top layer of artificial turf 14'. In particular, insert 18 is a laminate with backing plate 30 on the bottom, artificial turf 14' on the top and a layer of the shock absorbing material 18*a* sandwiched and coupled therebetween.

Shock absorbing materials may be quite soft and flexible. Backing plate 30 is formed of a relatively rigid material that can support the weight of the other layers 18*a* and 14' substantially without bending. Backing plate 30 includes a bottom and an upturned rim 30*a*. Rim 30 rides against the inner facing edges of cavity 22 and protects shock absorbing material 18*a* from wear against the cavity.

Because backing plate 30 is durable, the backing plate 30 can be placed directly on the ground surface beneath the mat. Cavity 22 need not have a floor. Rim 30*a* may have a flare such that it becomes generally wider at the top, such that while its bottom is about the same diameter as the inner edges of cavity, upper end of rim 30*a* is wider than the cavity and cannot pass down through the cavity. If tabs 28*a* are employed, these will also prevent the insert from dropping out of the bottom of the cavity if the mat is lifted. Also, if tabs 28*a* are employed, backing plate 30 may have indentations on its perimeter that form notches 28*b*.

Rim 30*a* may have a height shorter that the height of the insert, such that the rim is recessed from the upper surface of top layers 14', 14".

Backing plate 30 may also include drainage openings for permitting drainage of liquid from the insert. This is particularly useful where the mat is to be used outside where it will be rained on or receive spray from irrigation or cleaning operations. Notches 28*b* can be open through plate 30 to some degree to provide for drainage. For example, in the illustrated embodiment, rim 30*a* includes drainage openings 31. Drainage openings 31 in this embodiment are notches in the upper limit of the rim. The openings lower the height of the rim to at least below the level of the artificial turf such that liquids, such as precipitation, can drain from the artificial turf.

Insert 18 may also include a pull 33 or handle to facilitate lifting the insert out of the golf mat. In this embodiment, pull 33 is a finger-sized cutout in rim 30*a*.

Top layer 14' is attached as part of insert 18. Because the top layer tends to wear more where it is impacted by clubs, the top layer that covers the hitting area tends to wear more than that portion 14" at the edges of the mat. Thus, it is convenient and generates less waste to only replace insert 18 along with its top layer 14' while top layer portion 14" about the cavity on main structure 16 may be retained for further use. Top layer portion 14" can be releasably or permanently installed to main structure 16.

Figure 10:
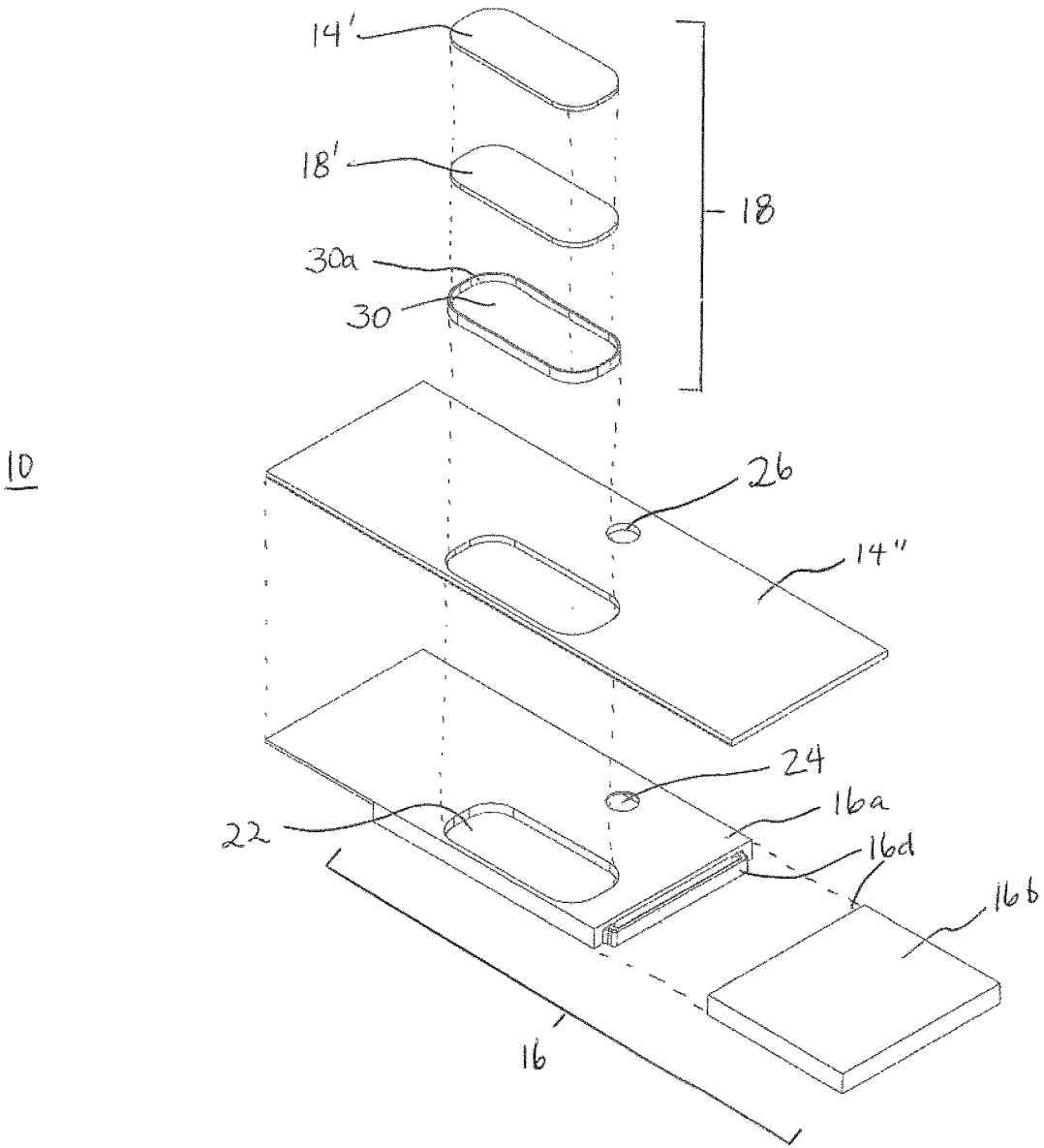
FIG. 10 is an exploded top perspective view of another golf mat.

Another golf mat 10 with a laminate insert 18 is shown in FIG. 10. In that mat, insert 18 includes a backing plate 30 that is shaped as a rectangular dish with side walls 30*a*.

A layer of shock absorbing material 18' is installed to fill the bottom of backing plate 30 and a sheet of artificial turf 14' is installed on top of material 18'. Insert 18 is installed in a cavity 22 in the main structure 16. Cavity 22 is rectangular-shaped recess in the upper surface of main structure 16, which extends at least partly into the thickness of the main structure. In the mat of FIG. 10, main structure 16 includes a plurality of sub-parts 16*a*, 16*b* with interlocking edges 16*d*. Main structure 15 includes a tee placement hole 24 that is sized to accommodate a tee holder. A sheet 14" of artificial turf overlies the main structure and surrounds the cavity, leaving space for insert 18 to be placed in and removed from the cavity.

The various features and options may be incorporated in a mat each alone or in various combinations.

To install a mat according to the present invention, a mat base is constructed by placing the base main structure 16 in position on a ground surface. This may include interlocking segments such as main structure segments 16*a*-16*c*.

Next, the insert 18 is installed in cavity 22 of the main structure to complete base.

If the top layer is not already attached to insert 18 and main structure 16, top layer 14 may be installed over the main structure and insert 18. Top layer 14 may be releasably connected to base 12.

After use, if the top layer shows wear, the top layer may be moved or replaced. In the embodiment of FIG. 3, the entirety of top layer 14 may be lifted and rotated to position another area of the mat over the area of base where most wear occurs. This means lifting the top layer, rotating it to align one of the other tee holes 26, 26' over tee placement hole 24. In the embodiment of FIG. 7, insert 18 may be rotated within cavity 22 to move a new area of the insert into the region receiving the most use. If there is a releasable lock, such as tabs 28*a* and notches 28*b*, removal may require releasing the lock, for example, lifting the insert to move notches 28*b* out of engagement with the tabs, rotating the insert and reinstalling the insert into cavity, with the lock reengaged.

If insert begins to show signs of wear, it may also be reoriented in its cavity or replaced.

The previous description of the disclosed embodiments is provided to enable any person skilled in the art to make or use the present invention. Various modifications to those embodiments will be readily apparent to those skilled in the art, and the generic principles defined herein may be applied to other embodiments without departing from the scope of the claims. Thus, the present invention is not intended to be limited to the embodiments shown herein, but is to be accorded the full scope consistent with the claims, wherein reference to an element in the singular, such as by use of the article "a" or "an" is not intended to mean "one and only one" unless specifically so stated, but rather "one or more". All structural and functional equivalents to the elements of the various embodiments described throughout the disclosure that are known or later come to be known to those of ordinary skill in the art are intended to be encompassed by the elements of the claims. Moreover, nothing disclosed herein is intended to be dedicated to the public regardless of whether such disclosure is explicitly recited in the claims.

We claim:

1. A golf mat comprising:

a base, the base including a main structure and an insert in the main structure along one side edge of the main structure, the insert configured to have shock absorption properties and including a layer of viscoelastomeric material, the viscoelastomeric material being solid without springs, hollowed out chambers, foam or fluid fill;

a second insert along an opposite side edge of the main structure, the second insert including a layer of solid shock absorbing polymer, to thereby configure the golf mat for use by both left and right-handed golfers; and a top layer of artificial turf sheet material installed on the base and overlying at least a portion of the main structure, the insert and the second insert.

2. The golf mat of claim 1 further comprising a cavity on an upper surface of the main structure and wherein the insert is accommodated in the cavity.

3. The golf mat of claim 2 wherein at least one of the insert and the cavity are configured to prevent the insert from falling out from the bottom of the cavity.

4. The golf mat of claim 2 wherein the cavity is located a distance from the one side edge of the main structure and the top layer of artificial turf sheet material covers the distance between the one side edge and the cavity and further comprising a hole passing through the top layer of artificial turf sheet material, the hole being located in the distance between the cavity and the one side edge of the main structure.

5. The golf mat of claim 1 wherein the insert is circular.

6. The golf mat of claim 1 wherein the insert includes a backing plate supporting the layer of shock absorbing material, wherein the backing plate is more stiff than the layer of shock absorbing material.

7. The golf mat of claim 6 wherein the top layer is attached to the layer of shock absorbing material.

8. The golf mat of claim 1 wherein the insert and the main structure include cooperating parts of a releasable lock configured to releasably lock the insert against displacement relative to the main structure.

9. A golf mat comprising:

a base, the base including a main structure with an upper surface and an open topped cavity in the upper surface; and an insert sized to be accommodated in the cavity, the insert including a layer of solid polymeric material selected to have shock absorption properties greater than the main structure, the solid polymeric material being a viscoelastomeric material without springs, hollowed out chambers, foam or fluid fill;

artificial turf installed on the base and overlying at least a portion of the main structure and the insert; and a tee-accommodating hole in the artificial turf alongside and spaced from the insert.

10. The golf mat of claim 9 wherein the insert is a laminate including a backing plate supporting the layer and the artificial turf includes a portion connected to the layer.

11. The golf mat of claim 10 further comprising a rim on the backing plate extending up from a bottom of the backing plate and the layer is positioned within the rim.

12. The golf mat of claim 9 wherein the cavity and the insert are each circular.

13. The golf mat of claim 12 further comprising a releasable lock between the insert and the cavity to restrict the insert from rotating within the cavity.

14. The golf mat of claim 13 wherein the releasable lock includes a plurality tabs radially inwardly extending from inner facing walls of the cavity and a plurality of alignable notches on the insert, the plurality of notches configured to fit over and engage the plurality of tabs.

15. The golf mat of claim 9 wherein the artificial turf includes a side edge and the insert is spaced a distance from the side edge and the tee-accommodating hole is located in the distance between the insert and the side edge.

16. A golf mat comprising:

an artificial turf layer including an upper surface defining a top surface of the golf mat, an underside, a first side edge and a second side edge opposite the first side edge;

a first shock absorbing insert coupled to the underside of the artificial turf layer and positioned with a space between the first shock absorbing insert and the first side edge;

a second shock absorbing insert coupled to the underside of the artificial turf layer and positioned spaced from the first shock absorbing insert and adjacent to but spaced from the second side edge, the first shock absorbing insert and the second shock absorbing insert each including a layer of viscoelastomeric material, the viscoelastomeric material being solid without springs, hollowed out chambers, foam or fluid fill; and a tee hole extending through the artificial turf layer in the space between the first shock absorbing insert and the first side edge.

17. The golf mat of claim 16 further comprising a second tee hole extending through the artificial turf layer between the second shock absorbing insert and the second side edge.

18. The golf mat of claim 16 further comprising a base structure on which the artificial turf layer, the first shock absorbing insert and the second shock absorbing insert are supported and the base structure includes a hole aligned under the tee hole.

* * * * *